US010496005B1

(12) United States Patent
Sasaki

(10) Patent No.: US 10,496,005 B1
(45) Date of Patent: Dec. 3, 2019

(54) IMAGE FORMING APPARATUS AND METHOD FOR DIAGNOSING FAILURE OCCURRENCE LOCATION THEREOF

(71) Applicant: TOSHIBA TEC KABUSHIKI KAISHA, Shinagawa-ku, Tokyo (JP)

(72) Inventor: Hidehito Sasaki, Ota (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/111,444

(22) Filed: Aug. 24, 2018

(51) Int. Cl.
*G03G 15/043* (2006.01)
*G03G 15/08* (2006.01)

(52) U.S. Cl.
CPC ..... *G03G 15/043* (2013.01); *G03G 15/0849* (2013.01)

(58) Field of Classification Search
CPC ..... G03G 15/043; G03G 15/0849
See application file for complete search history.

(56) References Cited

U.S. PATENT DOCUMENTS 9,310,714 B2 4/2016 Ozaki et al.
2010/0296822 A1* 11/2010 Takada ..... G03G 15/0131 399/9

FOREIGN PATENT DOCUMENTS

JP 2007286263 A * 11/2007

* cited by examiner

*Primary Examiner* — Susan S Lee
(74) *Attorney, Agent, or Firm* — Amin, Turocy & Watson, LLP

(57) ABSTRACT

In an exposure section of an image forming apparatus, a plurality of light emitting elements is divided into a plurality of blocks, and the plurality of the light emitting elements belonging to the same block is driven by one driving circuit. A toner adhesion sensor acquires density information of the toner images transferred onto a surface of the transfer belt of an image forming section. A controller controls the exposure section and the image forming section to form a dedicated pattern containing toner images corresponding to the plurality of the light emitting elements on the surface of the transfer belt, and diagnose the plurality of light emitting elements and other failure occurrence locations in the image forming apparatus from the density information of the toner images corresponding to the plurality of the light emitting elements in the dedicated pattern, which is acquired by the toner adhesion sensor.

20 Claims, 12 Drawing Sheets

IMAGE FORMING APPARATUS AND METHOD FOR DIAGNOSING FAILURE OCCURRENCE LOCATION THEREOF

FIELD

Embodiments described herein relate generally to an image forming apparatus and a method for diagnosing a failure occurrence location thereof.

BACKGROUND

An image forming apparatus has a printer that forms a visible image according to image data on a sheet. As the image forming apparatus, a MFP (Multi-Functional Peripheral) having a scanner for acquiring characters, illustrations, or photographs on an object to be read as intensity of light and generating image data corresponding to the intensity in addition to the printer is widely used. An electrophotographic printer is widely used as the printer of the image forming apparatus. Such a printer has a plurality of light sources for emitting laser beams to form an electrostatic latent image.

Such an image forming apparatus performs an image quality maintaining control for keeping an image density constant regardless of environmental conditions. The image quality maintaining control is a control for adjusting image densities of all colors including yellow (Y), cyan (C), magenta (M), and black (K) to respective target values of YMCK. The adjustment is performed by regulating laser power, charging/developing bias high voltage output and primary transfer high voltage output of each of a laser optical system, a developing device and a transfer belt which are used for image formation. In the image quality maintaining control, if the image density cannot be adjusted to the target value, it is determined that an abnormality occurs, and the abnormality is notified to a user through a message such as an error display on a display section of an operation panel of the image forming apparatus.

A toner adhesion sensor for detecting the toner density is used in the image quality maintaining control. Specifically, a dedicated pattern for each color of YMCK is printed on a surface of a transfer belt, and the dedicated pattern is read by the toner adhesion sensor to detect the toner density.

Although the abnormality in the density is notified through detection of an image defect in the image quality maintaining control, it is not possible to determine whether the abnormality in the density is caused by failure in any one of the laser optical system, the developing device, and the transfer belt which are used for image formation, in other words, it is not possible to specify a failure occurrence location. Therefore, much time is required to specify the failure occurrence location at the time of maintenance.

As a result, there is a case in which the image forming apparatus has an overcurrent detection function (LD breakage detection), a voltage leakage detection function for any one of the laser power, the charging high voltage output, and the primary transfer high voltage output as failure detection functions on hardware of each of the laser optical system, the developing device, and the transfer belt. However, this is an additional function, resulting in an increase in cost.

DETAILED DESCRIPTION

Provided is an image forming apparatus capable of specifying a failure occurrence location without increasing the cost.

In accordance with an embodiment, an image forming apparatus, which forms an image on a sheet, comprises an exposure section in which a plurality of light emitting elements is divided into a plurality of blocks, and the plurality of the light emitting elements belonging to the same block is driven by one driving circuit; an image forming section configured to include a charging device, a photoconductive drum which is charged by the charging device and is exposure by light emitted from the exposure section to form an electrostatic latent image thereon, and a developing device which includes a developing roller for supplying a toner and forms a toner image on the photoconductive drum by developing the electrostatic latent image on the photoconductive drum; a transfer belt onto which the toner image on the photoconductive drum is transferred; a toner adhesion sensor configured to acquire density information of the toner images transferred onto a surface of the transfer belt; and a controller configured to control the exposure section and the image forming section to form a dedicated pattern containing toner images corresponding to the plurality of the light emitting elements on the surface of the transfer belt and to diagnose the plurality of light emitting elements and other failure occurrence locations in the image forming apparatus from the density information of the toner images corresponding to the plurality of the light emitting elements in the dedicated pattern, which is acquired by the toner adhesion sensor.

Hereinafter, an embodiment is described with reference to the accompanying drawings.

Figure 1:
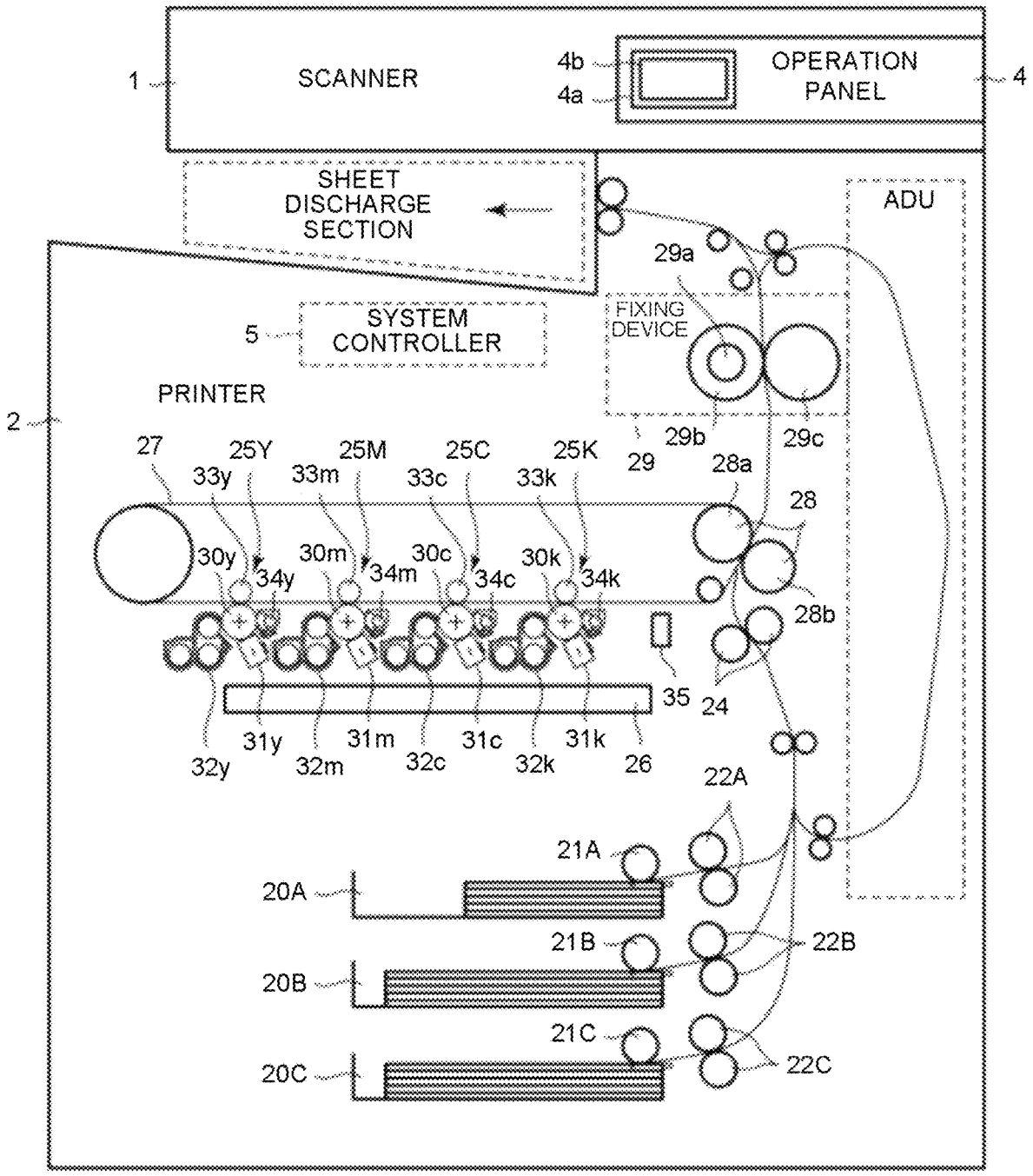
FIG. 1 is a schematic diagram illustrating an example of a configuration of an image forming apparatus according to an embodiment.

FIG. 1 is a cross-sectional view schematically illustrating an example of a configuration of an image forming apparatus according to an embodiment. The image forming apparatus shown in FIG. 1 is a MFP, and comprises a scanner 1, a printer 2, an operation panel 4 and a system controller 5.

The scanner 1 is used to read an image of a document to convert it to image data. The scanner 1 is, for example, a CCD (Charge Coupled Device) line sensor for converting an image on a reading surface of the document into image data. The scanner 1 may have a function of scanning a document placed on a document table glass. The scanner 1 may have a function of reading the image of the document conveyed by an ADF (Auto Document Feeder). The scanner 1 is installed, for example, at the upper side of a main body of the MFP. The scanner 1 is controlled by the system controller 5. The scanner 1 outputs the image data of the document to the system controller 5.

The printer 2 is an electrophotographic type printer. The printer 2 forms an image on a sheet as an image receiving medium. The printer 2 has a color printing function of printing a color image on the sheet and a monochrome printing function of printing a monochrome image (for example, black) on the sheet. The printer 2 forms a color image using toners of a plurality of colors (for example, three colors, i.e., yellow (Y), cyan (C) and magenta (M)). The printer 2 forms a monochrome image using monochrome (for example, black (K)) toner.

In the example of the configuration shown in FIG. 1, the printer 2 includes sheet feed cassettes 20 (20A, 20B and 20C). The sheet feed cassette 20 is a sheet feed section which supplies a sheet to be used for printing of an image. The printer 2 may include a manual feed tray as the sheet feed section. For example, each of the sheet feed cassettes 20A, 20B and 20C is provided in a state of being detachable at the bottom of the main body of the MFP. The sheet feed cassettes 20A, 20B and 20C store set types (for example, size or sheet quality) of sheets, respectively.

The sheet feed cassettes 20A, 20B and 20C include pickup rollers 21A, 21B and 21C, respectively. The pickup rollers 21A, 21B and 21C pick up sheets one by one from the sheet feed cassettes 20A, 20B and 20C. The pickup rollers 21A, 21B and 21C supply the sheets taken out to a conveyance path (conveyance section 22) composed of a plurality of conveyance rollers 22A, 22B and 22C.

The conveyance section 22 conveys the sheet in the printer 2. For example, the conveyance section 22 conveys the sheet taken out by the pickup rollers 21A, 21B and 21C to a registration roller 24. The registration roller 24 conveys the sheet to a transfer position at a timing of transferring an image from a transfer belt 27 onto the sheet. The conveyance section 22 conveys the sheet passing through the registration roller 24 to a transfer position. The conveyance section 22 conveys the sheet passing through the transfer position from the transfer position to a fixing device 29. The conveyance section 22 conveys the sheet passing through the fixing device 29 to either a sheet discharge section or an ADU (Automatic Double-Sided Unit).

The image forming section 25 (25Y, 25M, 25C or 25K) forms an image to be transferred onto the sheet. In the example of the configuration shown in FIG. 1, the image forming section 25Y forms an image with yellow toner. The image forming section 25M forms an image with magenta toner. The image forming section 25C forms an image with cyan toner. The image forming section 25K forms an image with black toner.

Each image forming section 25 (25Y, 25M, 25C, or 25K) includes a photoconductive drum 30 (30*y*, 30*m*, 30*c*, or 30*k*), a charging device 31 (31*y*, 31*m*, 31*c*, or 31*k*), a developing device 32 (32*y*, 32*m*, 32*c*, or 32*k*), a transfer roller 33 (33*y*, 33*m*, 33*c*, or 33*k*), and a cleaner 34 (34*y*, 34*m*, 34*c*, or 34*k*).

The photoconductive drum 30 is an image carrier on which an electrostatic latent image is formed. The photoconductive drum 30 rotates around a rotation axis. The charging device 31 charges a surface of the photoconductive drum 30 to a predetermined potential. The charging device 31 has a grid (not shown) for adjusting a charging output of the photoconductive drum 30. The developing device 32 develops the electrostatic latent image formed on the photoconductive drum 30 with the toner. The transfer roller 33 transfers the toner image developed on the photoconductive drum 30 onto the transfer belt 27. The cleaner 34 cleans the surface of the photoconductive drum 30 after transfer.

An exposure section 26 forms an electrostatic latent image on the photoconductive drum 30 of each image forming section 25 (25Y, 25M, 25C or 25K) using laser beam. The exposure section 26 irradiates the photoconductive drum 30 with the laser beam controlled according to the image data via an optical system such as a polygon mirror. The laser beam from the exposure section 26 forms the electrostatic latent image on the surface of each photoconductive drum 30. The exposure section 26 controls the laser beam in response to a control signal from the system controller 5.

Each image forming section 25 (25Y, 25M, 25C or 25K) develops the electrostatic latent image formed on each the photoconductive drum 30 by the developing device 32. The developing device 32 includes a developing container having a developing roller. The developing container accommodates the toner as a developer of each color. The toner is charged by being stirred in the developing container together with the carrier. A developing bias is applied to the developing roller. The developing roller to which the developing bias is applied supplies the toner to the electrostatic latent image on the photoconductive drum 30. The electrostatic latent image on the photoconductive drum 30 is developed to become a toner image by using the supplied toner.

The transfer belt 27 is an intermediate transfer body. Each image forming section 25 (25Y, 25M, 25C or 25K) transfers the toner image formed on the photoconductive drum 30 onto the transfer belt 27 (primary transfer) by applying a primary transfer voltage to the transfer belt 27 by the transfer roller 33. For example, in the image forming section 25K, the toner image developed by the developing device 32*k* using the black toner is transferred onto the transfer belt 27 by the transfer roller 33*k*. In a case of forming a color image, the image forming sections 25Y, 25M, 25C and 25K transfer toner images developed by using toners of respective colors onto the transfer belt 27 in an overlapped manner.

The transfer section 28 transfers the toner image on the transfer belt 27 onto the sheet at a secondary transfer position. The secondary transfer position is a position at which the toner image on the transfer belt 27 is transferred onto the sheet. The secondary transfer position is a position where a support roller 28*a* and a secondary transfer roller 28*b* face each other.

The fixing device 29 fixes the toner image on the sheet. The fixing device 29 applies the heat for fixing to the sheet. In the example shown in FIG. 1, the fixing device 29 includes a heat roller 29*b* containing a heating section 29*a* therein, and a pressure roller 29*c* in contact with the fixing belt heated by the heat roller 29 *b* under pressure. The heating section 29*a* may be any heater as long as the temperature thereof can be controlled. For example, the heating section 29*a* may be a heater lamp such as a halogen lamp or an IH (Induction Heating) type heater. The heating section 29*a* may include a plurality of heaters. The fixing device 29 conveys the sheet on which a fixing processing is performed to either the sheet discharge section or the ADU.

Between the image forming section 25K and the transfer section 28, a toner adhesion sensor 35 for detecting toner density is provided. The toner adhesion sensor 35 detects the toner density by reading a dedicated pattern printed on the surface of the transfer belt 27.

The operation panel 4 is a user interface. The operation panel 4 includes various buttons and a display section 4*a* including a touch panel 4*b*. The system controller 5 controls contents displayed on the display section 4*a* of the operation panel 4. The display section 4*a* functions as a notification section. The operation panel 4 outputs information input through the touch panel 4*b* of the display section 4*a* or the buttons to the system controller 5. The user designates an operation mode with the operation panel 4, and inputs information such as setting information.

Next, the configuration of the exposure section 26 is described.

Figure 2:
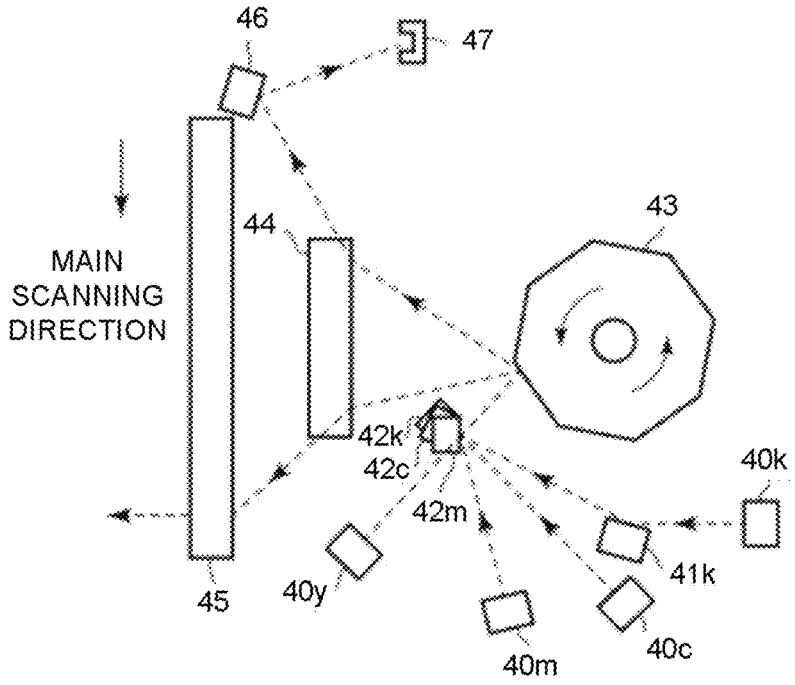
FIG. 2 is a diagram illustrating an example of a configuration of an exposure section used in the image forming apparatus according to the embodiment.
Figure 3:
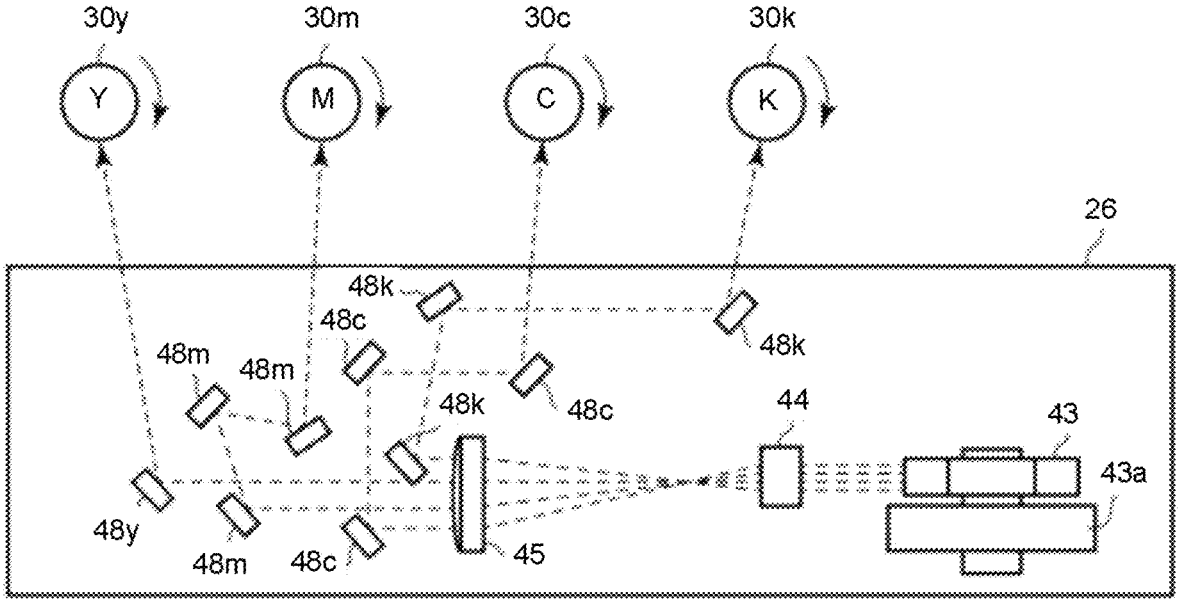
FIG. 3 is a cross-sectional view illustrating an example of a configuration of the exposure section disposed in the image forming apparatus according to the embodiment.

FIG. 2 is a diagram illustrating the configuration of the exposure section 26 according to the embodiment. FIG. 3 is a cross-sectional view illustrating the configuration of the exposure section 26 installed in the image forming apparatus according to the embodiment.

The exposure section 26 shown in FIG. 2 and FIG. 3 includes exposure units of respective colors used for image formation. In the image forming apparatus which forms a color image as shown in FIG. 1, the exposure section 26 has exposure units of respective colors used for forming color images. In the image forming apparatus which forms only a monochrome image, the exposure section 26 may include a set of exposure units for forming the monochrome image.

The exposure section 26 shown in FIG. 2 and FIG. 3 includes the exposure units for respective colors including yellow, magenta, cyan, and black, and a BD (Beam Detect) detection section. The exposure unit for each color includes a laser unit 40 (40*y*, 40*m*, 40*c*, or 40*k*) and an optical system. The laser unit 40 has a plurality of light emitting elements. For example, the laser unit 40 includes a laser array in which a plurality of LDs (laser diodes) is arrayed. An example of a configuration of the laser unit 40 is described later. The optical system constituting the exposure unit for each color is constituted by a mirror 41*k*, mirrors 42 (42*m*, 42*c* and 42*k*), a polygon mirror 43, lenses 44 and 45, mirror groups 48 (48*y*, 48*m*, 48*c* and 48*k*), and the like.

The exposure unit for yellow includes a laser unit 40*y*, a polygon mirror 43, lenses 44 and 45, and a mirror group 48*y*. The laser unit 40*y* emits a laser beam for forming a yellow image. The polygon mirror 43, the lenses 44 and 45, and the mirror group 48*y* are optical systems for guiding the laser beam emitted by the laser unit 40*y* to the photoconductive drum 30*y*. The polygon mirror 43 is rotated by a motor 43*a*. The polygon mirror 43 rotates to enable the laser beam to scan in a main scanning direction on the photoconductive drum 30*y*. The main scanning direction refers to a direction of a rotation axis of the photoconductive drum 30*y*. A scanning position of the laser beam emitted by the laser unit 40*y* moves in a sub-scanning direction on the photoconductive drum 30*y* by the polygon mirror 43 rotating. The sub-scanning direction refers to a direction orthogonal to the main scanning direction.

The exposure unit for magenta includes a laser unit 40*m*, a mirror 42*m*, a polygon mirror 43, lenses 44 and 45, and a mirror group 48*m*. The laser unit 40*m* emits a laser beam for forming a magenta image. The polygon mirror 43, the lenses 44 and 45, and the mirror group 48*m* are optical systems for guiding the laser beam emitted by the laser unit 40*m* to the photoconductive drum 30*m*. The polygon mirror 43 is rotated by the motor 43*a*. The polygon mirror 43 rotates to enable the laser beam to scan in the main scanning direction on the photoconductive drum 30*m*. The main scanning direction refers to a direction of a rotation axis of the photoconductive drum 30*m*. A scanning position of the laser beam emitted by the laser unit 40*m* moves in the sub-scanning direction on the photoconductive drum 30*m* by the polygon mirror 43 rotating. The sub-scanning direction refers to a direction orthogonal to the main scanning direction.

The exposure unit for cyan includes a laser unit 40*c*, a mirror 42*c*, a polygon mirror 43, lenses 44 and 45, and a mirror group 48*c*. The laser unit 40*c* emits a laser beam for forming a cyan image. The polygon mirror 43, the lenses 44 and 45, and the mirror group 48*c* are optical systems for guiding the laser beam emitted by the laser unit 40*c* to the photoconductive drum 30*c*. The polygon mirror 43 is rotated by the motor 43*a*. The polygon mirror 43 rotates to enable the laser beam to scan in the main scanning direction on the photoconductive drum 30*c*. The main scanning direction refers to a direction of a rotation axis of the photoconductive drum 30*c*. A scanning position of the laser beam emitted by the laser unit 40*c* moves in the sub-scanning direction on the photoconductive drum 30*c* by the polygon mirror 43 rotating. The sub-scanning direction refers to a direction orthogonal to the main scanning direction.

The exposure unit for black includes a laser unit 40*k*, mirrors 41*k* and 42*k*, a polygon mirror 43, lenses 44 and 45, and a mirror group 48*k*. The laser unit 40*k* emits a laser beam for forming a black image. The polygon mirror 43, the lenses 44 and 45, and the mirror group 48*k* are optical systems for guiding the laser beam emitted by the laser unit 40*k* to the photoconductive drum 30*k*. The polygon mirror 43 is rotated by the motor 43*a*. The polygon mirror 43 rotates to enable the laser beam to scan in the main scanning direction on the photoconductive drum 30*k*. The main scanning direction refers to a direction of a rotation axis of the photoconductive drum 30*k*. A scanning position of the laser beam emitted by the laser unit 40*k* moves in the sub-scanning direction on the photoconductive drum 30*k* by the polygon mirror 43 rotating. The sub-scanning direction refers to a direction orthogonal to the main scanning direction.

The BD detection section of the exposure section 26 includes a mirror 46 and a BD sensor 47. The mirror 46 guides the laser beam enabled to scan by the polygon mirror 43 to the BD sensor 47. The BD sensor 47 detects the laser beam from any one of the light sources in the laser units 40. The BD sensor 47 detects the laser beam as a signal (BD signal, reference signal) which is a reference for scanning in the main scanning direction. The BD sensor 47 is set on a scanning line along which the laser beam from the LD (reference light emitting element) to be detected scans. In other words, the BD sensor 47 detects that the laser beam is located at a reference position in the main scanning direction. The LD of each laser unit 40 is controlled to emit the laser beam based on the BD signal detected by the BD sensor 47.

Next, the configuration of each laser unit 40 is described.

Figure 4:
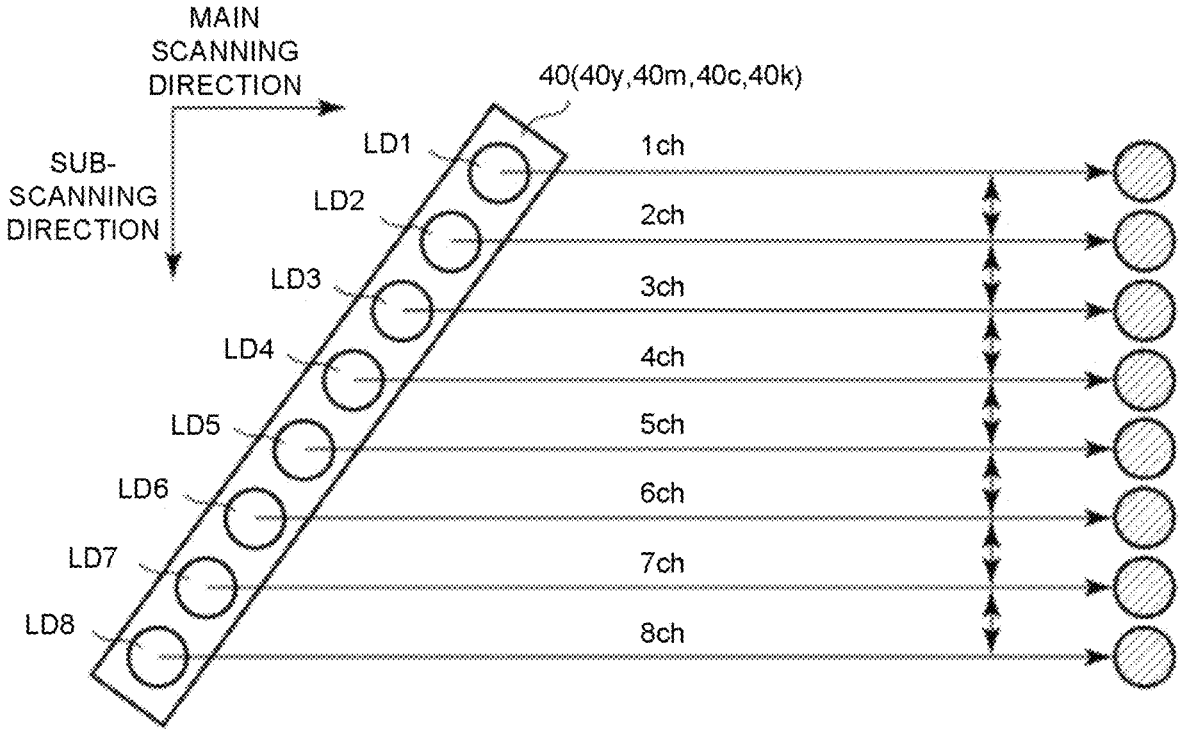
FIG. 4 is a diagram illustrating an example of a configuration of an eight-beam laser array as an example of a plurality of light sources used in the image forming apparatus according to the embodiment.

FIG. 4 is a diagram illustrating an example of a configuration of the laser unit 40 having eight LDs. The laser unit 40 is an eight-beam (8 ch) laser array in which eight LDs are arrayed. Here, it is assumed that the 8-beam laser array as the laser unit 40 is formed by aligning eight LDs in a straight line. The eight LDs (LD1, LD2, LD3, LD4, LD5, LD6, LD7, and LD8) in the 8-beam laser array can be turned on or off independently.

In the example shown in FIG. 4, the 8-beam laser array is installed in such a manner that an aligned direction of the eight LDs is inclined with respect to the sub-scanning direction (main scanning direction). If it is set that the aligned direction of the LDs is the same as the sub-scanning direction (perpendicular to the main scanning direction), a physical distance between adjacent LDs of the light sources corresponds to a resolution in the sub-scanning direction. Therefore, in the 8-beam laser array as the laser unit 40, it is set that an interval between adjacent LDs of the eight LDs in the sub-scanning direction corresponds to a desired interval of the resolution.

Next, the configuration of the control system of the image forming apparatus is described.

Figure 5:
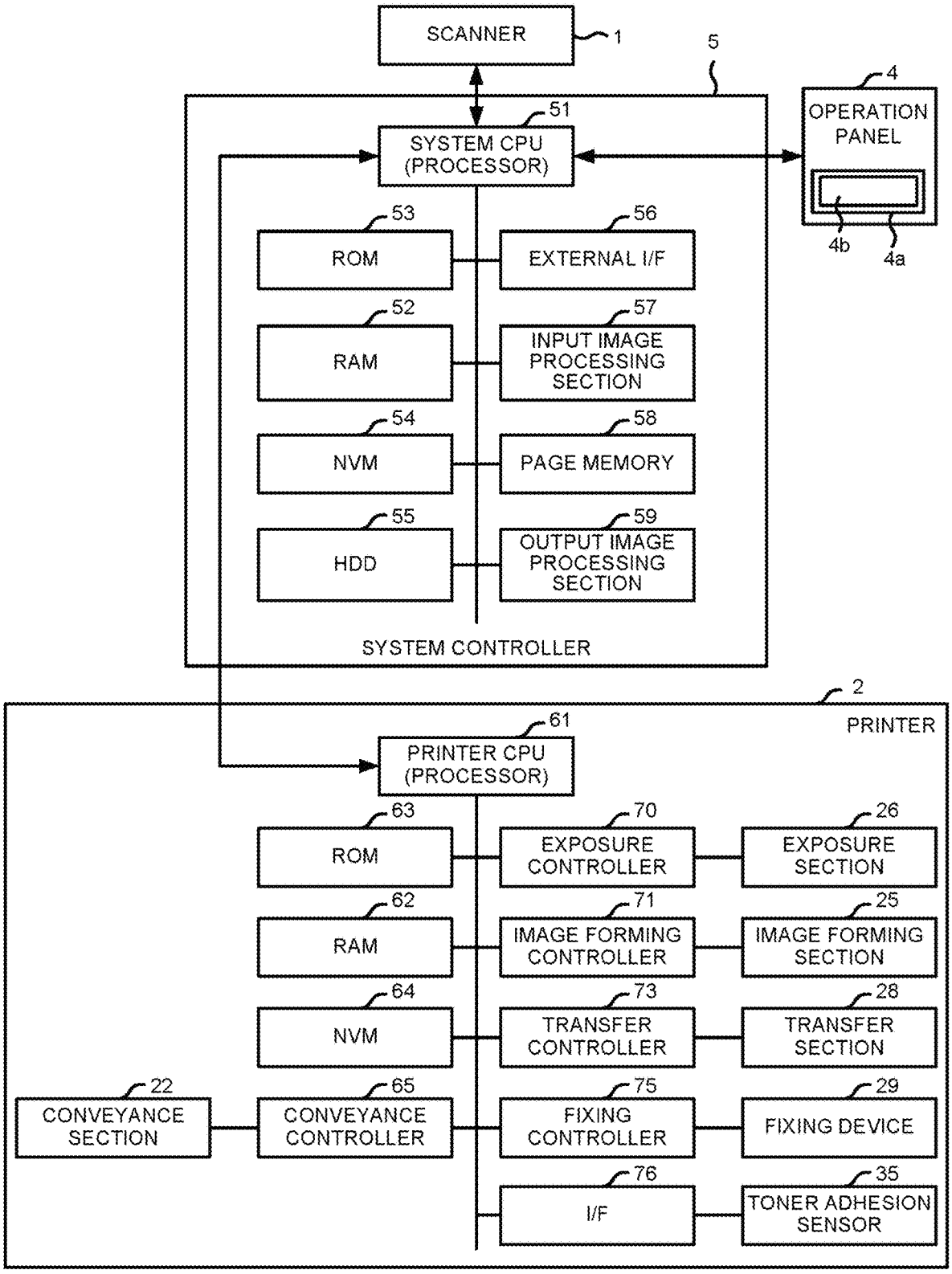
FIG. 5 is a block diagram illustrating an example of a configuration of a control system in the image forming apparatus according to the embodiment.

FIG. 5 is a block diagram schematically illustrating an example of configurations of the control systems of the system controller 5 and the printer 2 in the image forming apparatus.

In the example of the configuration, the system controller 5 includes a system CPU (Central Processing Unit) 51 acting as a processor, a RAM (Random Access Memory) 52, a ROM (Read Only Memory) 53, a NVM (Nonvolatile Memory) 54, a HDD (Hard Disk Drive) 55, an external interface (I/F) 56, an input image processing section 57, a page memory 58, and an output image processing section 59.

The system CPU 51 collectively controls each section of the image forming apparatus. The system CPU 51 realizes various processing by executing programs. The system CPU 51 is connected to each section in the system controller 5 via a system bus. The system CPU 51 is connected to the scanner 1, the printer 2, and the operation panel 4 via the system bus. The system CPU 51 outputs operation instructions to each section and acquires various information from each section through two-way communication with the scanner 1, the printer 2, and the operation panel 4.

The RAM 52 is a volatile memory. The RAM 52 functions as a working memory or a buffer memory. The ROM 53 is a nonvolatile memory which is not rewritable and is used for storing programs, control data, and the like. The system CPU 51 realizes various processing by executing programs stored in the ROM 53 (or the NVM 54, the HDD 55) while using the RAM 52. For example, the system CPU 51 realizes a function of instructing execution of printing and a function of prohibiting printing by executing programs.

The NVM 54 is a rewritable nonvolatile memory. The NVM 54 stores a control program to be executed by the system CPU and control data. The NVM 54 stores various setting information and processing conditions. For example, the NVM 54 stores setting information for each sheet feed cassette (sheet feed section).

The HDD 55 is a high-capacity storage device. The HDD 55 stores image data, various types of operation history information, and the like. The HDD 55 may store the control programs, the control data, and the like. The HDD 55 may store the setting information, the processing conditions, and the like.

The external I/F 56 is used for communicating with an external device. For example, the external interface 56 receives print data in response to a print request from the external device. The external interface 56 may be any interface as long as it can perform data notification with an external device. For example, the external interface 56 may be locally connected to the external device, or a network interface for performing communication via a network. The network includes the Internet.

The input image processing section 57 performs an image processing on the image data read by the scanner 1. The input image processing section 57 has functions of performing a shading correction processing, a gradation conversion processing, an interline correction processing, a compression/decompression processing, and the like. The input image processing section 57 stores the image data after the image processing in the page memory 58.

The page memory 58 is a memory for copying or decompressing the image data. For example, the page memory 58 stores the image data obtained by processing the image data read by the scanner 1 by the input image processing section 57. The page memory 58 may store the image data acquired by the external interface 56.

The output image processing section 59 generates image data for printing to be printed on the sheet by the printer 2. The output image processing section 59 performs an image processing for converting the image data stored in the page memory 58 to the image data for printing. The output image processing section 59 transmits the image data after image processing to the printer 2.

Next, an example of a configuration of the control system in the printer 2 is described.

In the configuration example shown in FIG. 5, the printer 2 includes a printer CPU (processor) 61, a RAM 62, a ROM 63, a NVM 64, a conveyance controller 65, an exposure controller 70, an image forming controller 71, a transfer controller 73, a fixing controller 75, and an interface (I/F) 76.

The printer CPU 61 controls the entire printer 2. The printer CPU 61 realizes various processing by executing programs. The printer CPU 61 is connected to each section in the printer 2 via a system bus. In response to an operation instruction from the system CPU 51, the printer CPU 61 outputs an operation instruction to each section in the printer 2. The printer CPU 61 transmits information indicating a processing status of the printer 2 to the system CPU 51.

The RAM 62 is a volatile memory. The RAM 62 functions as a working memory or a buffer memory. The ROM 63 is a nonvolatile memory which is not rewritable and is used for storing programs, control data and the like. The printer CPU 61 realizes various processing by executing programs stored in the ROM 63 (or the NVM 64) while using the RAM 62.

The NVM 64 is a rewritable nonvolatile memory. For example, the NVM 64 stores control programs to be executed by the printer CPU 61 and control data. The NVM 64 may store setting information, processing conditions, and the like.

The conveyance controller 65 controls conveyance of the sheet in the printer 2. The conveyance controller 65 controls driving of the pickup roller 21 and the conveyance rollers 22A, 22B and 22C of the conveyance section 22. The conveyance controller 65 controls driving of the conveyance rollers 22A, 22B and 22C of the conveyance section 22 in the printer 2 in response to an operation instruction from the printer CPU 61. For example, in response to an instruction to start an image forming processing from the system controller 5, the printer CPU 61 instructs the conveyance controller 65 to perform the conveyance control of the sheet.

The exposure controller 70 controls the exposure section 26. The exposure controller 70 forms the electrostatic latent image on the photoconductive drum 30 (30*y*, 30*m*, 30*c*, or 30*k*) of each image forming section 25 (25Y, 25M, 25C, or 25K) in response to an operation instruction from the printer CPU 61 with the exposure section 26. For example, the exposure controller 70 controls the laser beam that the exposure section 26 emits to each photoconductive drum 30 according to the image data for which a printing execution instruction is issued by the printer CPU 61. For example, the controller 70 controls the scanning of the laser beam emitted by each laser unit based on the BD signal acquired from the exposure section 26.

The image forming controller 71 controls the driving of each image forming section 25 (25Y, 25M, 25C, or 25K). For example, image forming controller 71 charges the photoconductive drum 30 to a predetermined potential with the charging device 31. The image forming controller 71 develops the electrostatic latent image formed on the photoconductive drum 30 after a charging processing with the developing device 32 by using the toners of respective colors. The image forming controller 71 controls the density of the toner used for developing by controlling a developing bias applied to the developing device 32. The image forming controller 71 transfers the toner image developed on the photoconductive drum 30 onto the transfer belt 27 with the transfer roller 33. The image forming controller 71 cleans the surface of the photoconductive drum 30 after a transfer processing with the cleaner 34.

The transfer controller 73 controls driving of the transfer section 28, a transfer current, and the like. In response to an operation instruction from the printer CPU 61, the transfer controller 73 transfers the toner image transferred onto the transfer belt 27 onto the sheet with the transfer section 28. The fixing controller 75 controls the driving of the fixing device 29. The fixing controller 75 drives the heat roller 29*b* and the pressure roller 29*c* in response to an operation instruction from the printer CPU 61. The fixing controller 75 controls the heating section 29*a* to control the surface temperature of the heat roller 29*b* so as to reach a fixing temperature.

The I/F 76 is a sensor interface that supplies a control signal from the printer CPU 61 to the toner adhesion sensor 35 and transmits a detection signal from the toner adhesion sensor 35 to the printer CPU 61.

Next, the control of the laser unit 40 of the exposure section 26 is described.

Figure 6:
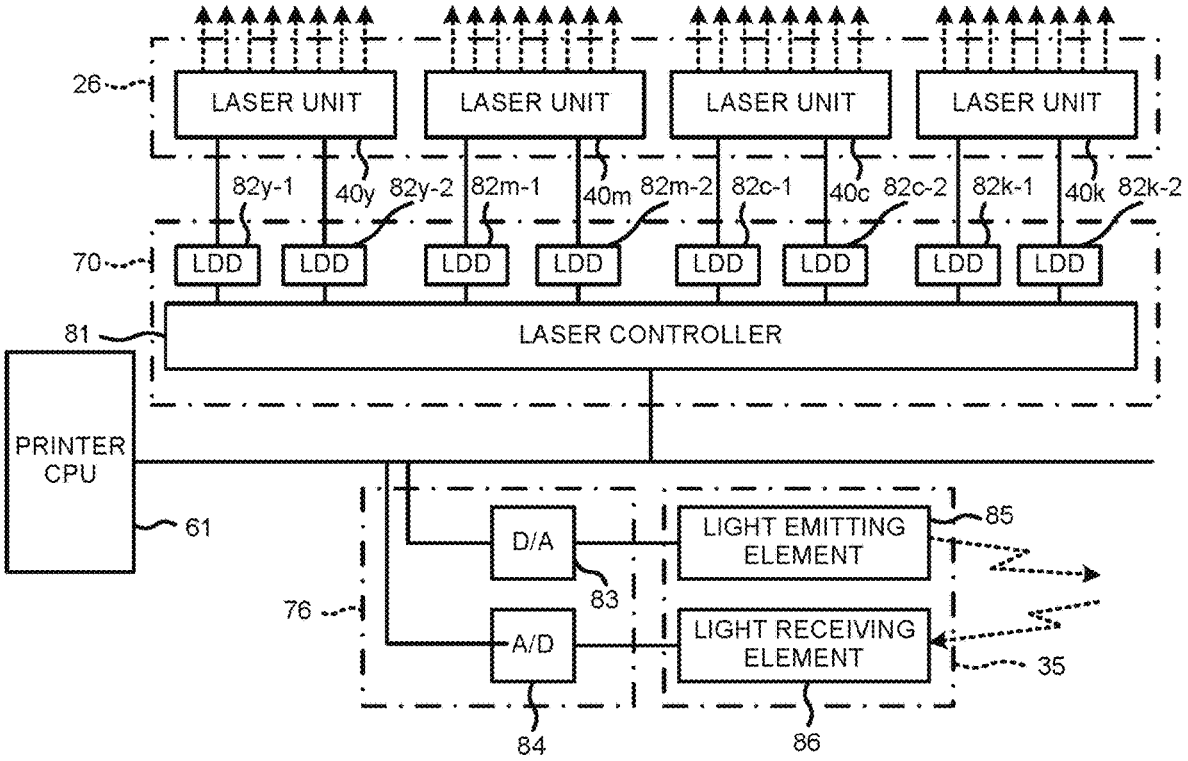
FIG. 6 is a diagram illustrating an example of configurations of the control system of the exposure section and a toner adhesion sensor in the image forming apparatus according to the embodiment.

FIG. 6 is a diagram illustrating an example of a configuration relating to control of the exposure section 26 by the exposure controller 70 and an example of a configuration of the toner adhesion sensor 35.

In the example shown in FIG. 6, the exposure controller 70 includes a laser controller 81 and a plurality of LD drive circuits (LD Drivers, LDDs) 82 (82*y*-1, 82*y*-2, 82*m*-1, 82*m*-2, 82*c*-1, 82*c*-2, 82*k*-1, and 82*k*-2). In the example of the configuration shown in FIG. 6, it is assumed that the laser unit 40 is constituted by the eight-beam laser array having eight LDs. As the LDD 82, an element that drives four LDs is generally used. Therefore, two elements are used for each color of YMCK, and the total number of the elements is eight.

According to the image data of the image to be formed, the laser controller 81 controls each LD of each laser unit 40 of the exposure section 26 via each LDD 82. The image data of the image to be formed is image data for printing to be printed on the sheet by the printer 2, which is transmitted from output image processing section 59 of the system controller 5. The image data is image data of a dedicated pattern, which is transmitted from the printer CPU 61 in some cases.

Although not specifically shown in FIG. 6, the laser controller 81 acquires a BD signal for each scanning when the photoconductive drum 30 is exposure with the laser beam emitted by the laser unit 40. The laser controller 81 synchronizes a writing timing in the main scanning direction according to the BD signal. The BD signal indicates that the laser beam emitted by any one of a plurality of LDs in the laser unit 40 is detected by the BD sensor 47.

The I/F 76 includes a D/A (Digital to Analog) converter 83 and an A/D (Analog to Digital) converter 84. The toner adhesion sensor 35 includes a light emitting element 85 such as an LED (Light Emitting Diode) and a light receiving element 86 such as a PD (Photo Diode).

The D/A converter 83 of the I/F 76 converts light quantity data designated by the printer CPU 61 to an light source control voltage of an analog and outputs it to the light emitting element 85 of the toner adhesion sensor 35. The light emitting element 85 projects the light corresponding to the light source control voltage to the transfer belt 27.

Figure 7:
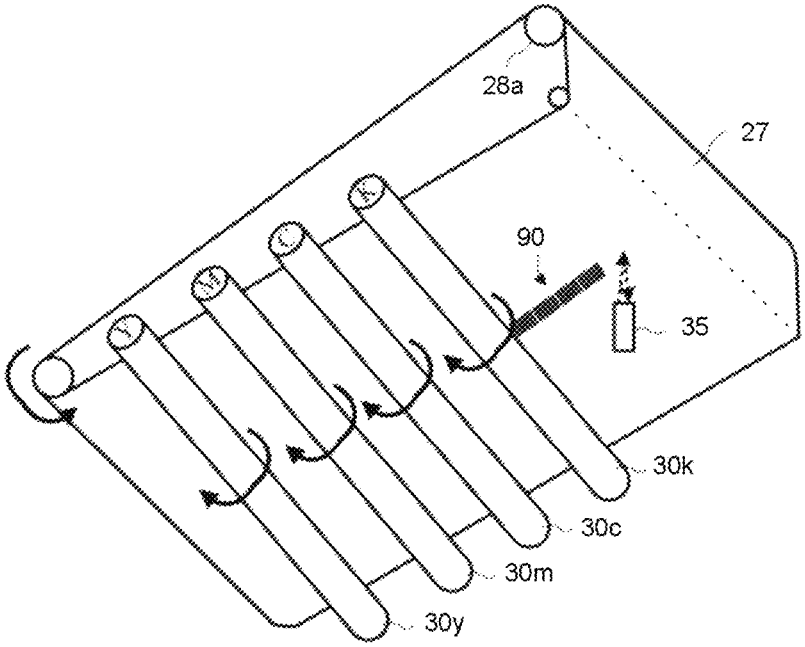
FIG. 7 is a perspective view illustrating a positional relationship between a dedicated pattern formed on a surface of a transfer belt and the toner adhesion sensor in the image forming apparatus according to the embodiment.
Figure 8:
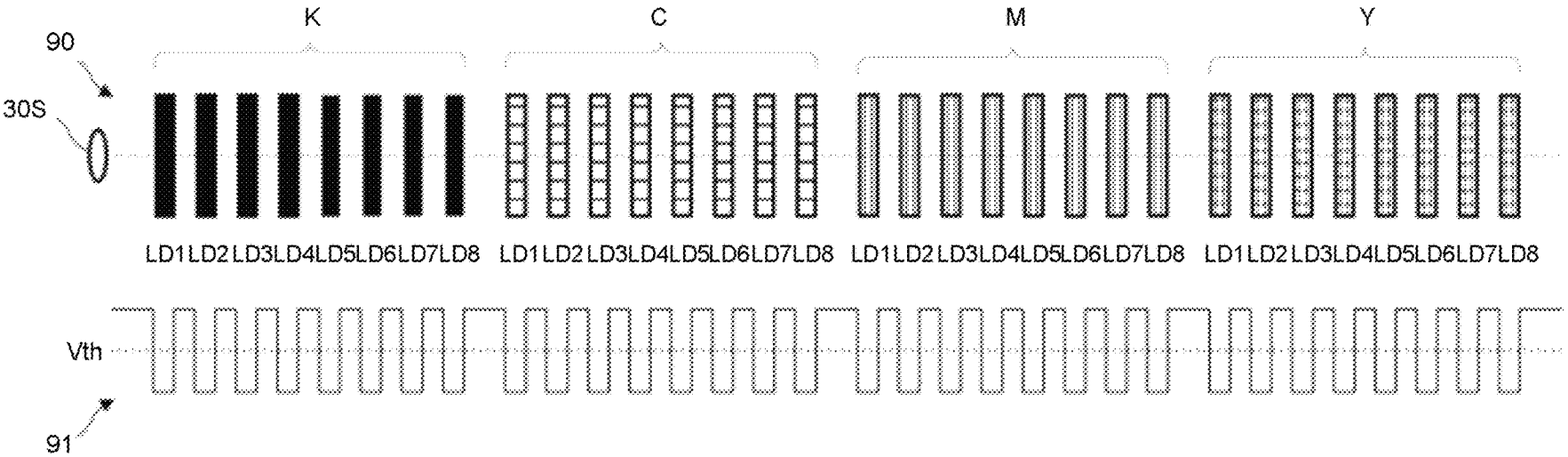
FIG. 8 is a diagram illustrating a dedicated pattern in a normal state and a detection waveform of the toner adhesion sensor in the image forming apparatus according to the embodiment.

FIG. 7 is a perspective view illustrating a positional relationship between a dedicated pattern 90 formed on the surface of the transfer belt and the toner adhesion sensor in the image forming apparatus according to the embodiment. FIG. 8 is a diagram illustrating the dedicated pattern 90 in a normal state and a detection waveform 91 of the toner adhesion sensor 35 in the image forming apparatus according to the embodiment.

As shown in FIG. 7 and FIG. 8, on the surface of the transfer belt 27, dedicated patterns 90 formed by toner images corresponding to respective LD (LD1 to LD8) of respective colors of YMCK are formed at intervals in a traveling direction (the sub-scanning direction) of the transfer belt 27. A width in the sub-scanning direction of each toner image corresponding to each LD is desired to be larger than a width in the sub-scanning direction of a spot light 30S which is formed on the surface of the transfer belt 27 by the projected light from the light emitting element 85 of the toner adhesion sensor 35.

The light receiving element 86 of the toner adhesion sensor 35 receives reflected light reflected by the toner image in the dedicated pattern 90 formed on the transfer belt 27 and the surface of the transfer belt where no toner image is formed, and outputs an output voltage corresponding to an amount of reflected light to the A/D converter 84 of the I/F 76. The A/D converter 84 converts the input output voltage of the light receiving element 86 into a digital value, and transmits the result to the CPU 61 as a density information detection value.

As shown in the detection waveform 91 in FIG. 8, if the dedicated pattern 90 is in the normal state, a density information detection value relating to the surface of the transfer belt 27 where no toner image is formed is equal to or greater than a density threshold value Vth, and the density information detection value relating to the surface of the transfer belt 27 where the toner image is formed is smaller than the density threshold value Vth.

For example, the printer CPU 61 keeps the amount of light received by the light receiving element 86 constant regardless of the color of the toner in the dedicated pattern 90 by changing an amount of light emitted by the light emitting element 85 of the toner adhesion sensor 35 according to the detected color of the toner. The printer CPU 61 can perform an image quality maintaining control for performing control to keep the image density at a target value based on the density information detection value from the toner adhesion sensor 35.

The printer CPU 61 can perform failure occurrence location diagnosis as described later by using the dedicated pattern 90 and the density information detection value from the toner adhesion sensor 35.

Next, a failure occurrence location diagnosis operation in the image forming apparatus according to the present embodiment is described.

Figure 9:
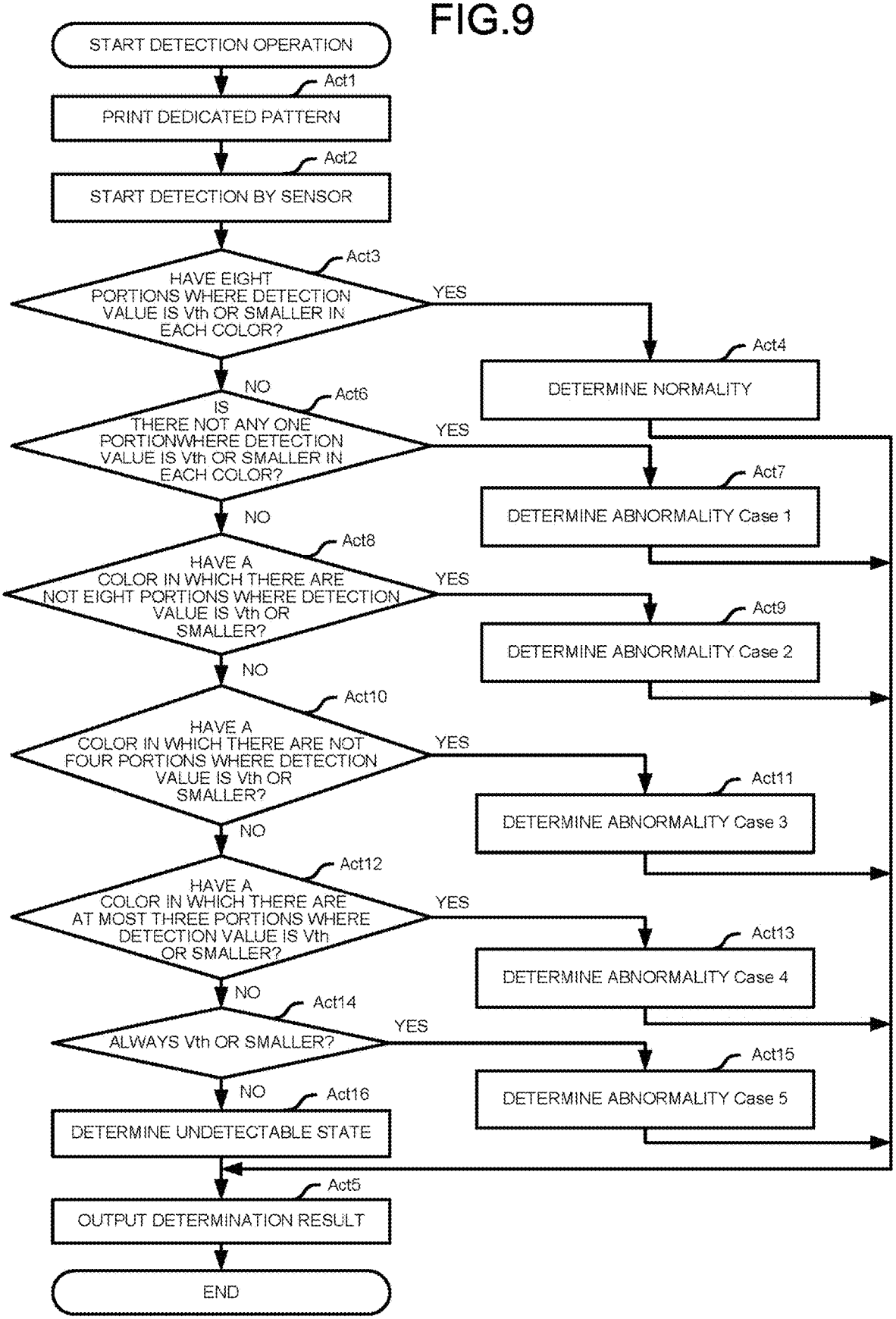
FIG. 9 is a flowchart for depicting an example of an operation by the image forming apparatus according to the embodiment.

FIG. 9 is a flowchart for depicting a flow of processing if the printer CPU 61 of the image forming apparatus according to the present embodiment executes the failure occurrence location diagnosis operation. The failure occurrence location diagnosis operation can be performed in a maintenance mode when a service person of the image forming apparatus sets the image forming apparatus to the maintenance mode by a predetermined operation of the operation panel 4. Alternatively, the failure occurrence location diagnosis operation may be performed automatically periodically. In any case, the printer CPU 61 starts a processing as shown in FIG. 9 by executing a program stored in the ROM 63 (or the NVM 64) in response to the failure occurrence location diagnosis instruction from the system CPU 51.

First, the printer CPU 61 controls the exposure section and the image forming section 25 via the exposure controller 70 and the image forming controller 71 to print the dedicated pattern 90 on the surface of the transfer belt (Act 1). Then, the printer CPU 61 enables the toner adhesion sensor 35 to start detection via the I/F 76 (Act 2).

Next, the printer CPU 61 determines whether or not there are eight portions where the density information detection value (detection waveform 91) by the toner adhesion sensor 35 acquired via the I/F 76 thereof is equal to or smaller than the density threshold value Vth for each color of YMCK (Act 3). As shown in FIG. 8, if there are eight portions where the density information detection value (detection waveform 91) is equal to or smaller than the density threshold value Vth in each color, the printer CPU 61 determines that there are eight portions where the density information detection value is equal to or smaller than the density threshold value Vth in each color. In this way, if it is determined that there are eight portions where the density information detection value is equal to or smaller than the density threshold value Vth in each color (Yes in Act 3), the printer CPU 61 determines that the image forming apparatus is in the normal state (Act 4). Then, the printer CPU 61 outputs the determination result, i.e., the normality determination result to the system CPU 51 which instructs the failure occurrence location diagnosis operation (Act 5), and terminates the processing of the failure occurrence location diagnosis operation.

Although not shown, the system CPU 51 receiving the determination result can notify the user or the service person by displaying the determination result on the display section 4*a* of the operation panel 4. Alternatively, the system CPU 51 may notify a remote monitoring device of the determination result as long as the remote management device (external device) can be accessed via the external I/F 56.

In Act 3, if it is determined that there are not eight portions where the density information detection value is equal to or smaller than the density threshold value Vth in each color, i.e., there is a color in which there are not eight portions where the density information detection value is equal to or smaller than the density threshold value Vth (No in Act 3), the printer CPU 61 determines whether or not there is no portion where the density information detection value (detection waveform 91) is equal to or smaller than the density threshold value Vth in each color of YMCK (Act 6). If it is determined that there is no portion where the density information detection value is equal to or smaller than the density threshold value Vth in each color, the printer CPU 61 determines that the image forming apparatus is in an abnormality Case 1 (Act 7).

Figure 10:
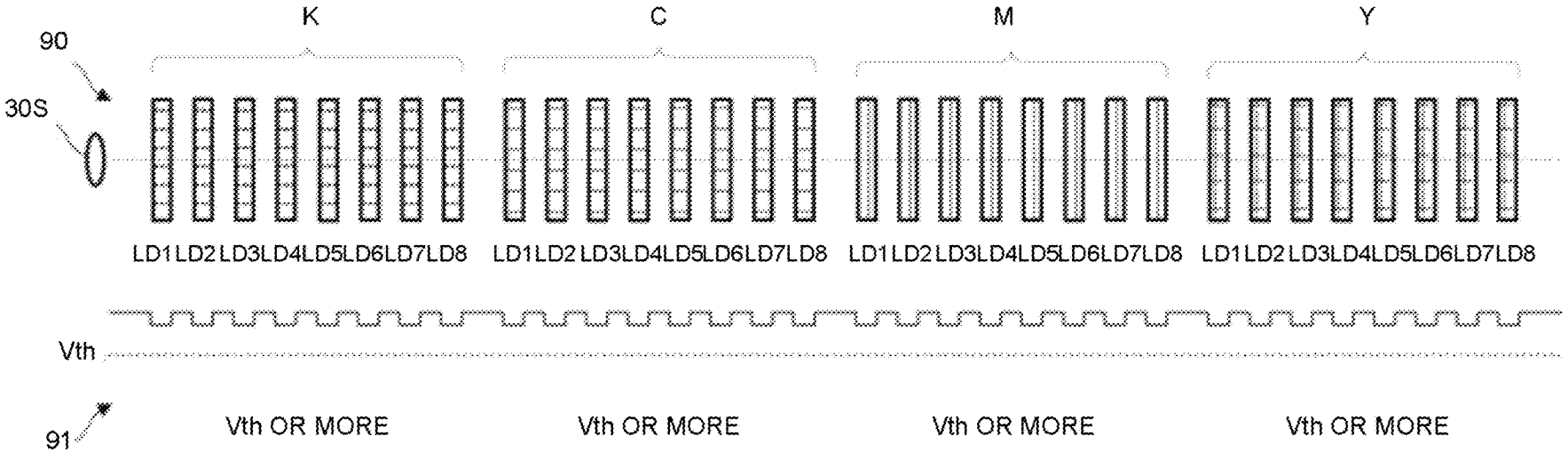
FIG. 10 is a diagram illustrating the dedicated pattern and the detection waveform of the toner adhesion sensor when abnormality Case 1 occurs in the image forming apparatus according to the embodiment.

FIG. 10 is a diagram illustrating the dedicated pattern 90 and the detection waveform 91 of the toner adhesion sensor 35 when the abnormality Case 1 occurs in the image forming apparatus according to the embodiment. In FIG. 10, for each color of YMC, the fact that a printing density of the toner image of the dedicated pattern 90 is thin is indicated by hatchings with wide intervals therebetween with respect to that fact in FIG. 8 for each color of YMC. For black (K), that the printing density is thin is indicated by a gray hatching. FIG. 11 to FIG. 14 described later are the same in the hatching.

As described above, when there is no portion where the density information detection value is equal to or smaller than the density threshold value Vth in each color, i.e., when the printing density is thin for all the colors, it is highly likely that positioning of the transfer belt is poor. The poor positioning of the transfer belt refers that a state in which a distance between the transfer belt 27 and each of the photoconductive drums 30*y*, 30*m*, 30*c*, and 30*k* is larger than a prescribed distance. Therefore, in such a case, the printer CPU 61 predicts that the failure occurrence location is the position of the transfer belt and determines the poor positioning of the transfer belt as the abnormality Case 1.

Then, the printer CPU 61 outputs the determination result, i.e., determination of the abnormality Case 1 to the system CPU 51 that instructs the failure occurrence location diagnosis operation (Act 5), and terminates the processing of the failure occurrence location diagnosis operation. The system CPU 51 receiving the determination result displays the determination result, for example, "there is a possibility that the positioning of the transfer belt is poor" on the display section 4*a* of the operation panel 4 to notify the user or the service person of the determination result. Alternatively, the system CPU 51 may notify the determination result to the remote monitoring device (external device) via the external I/F 56.

The system CPU 51 may display a message for promoting maintenance by the service person such as inspection or replacement of a location where the failure occurs. For example, the system CPU 51 may display a guidance for prompting adjustment of the position of the transfer belt 27 where the failure occurs on the display section 4*a*, or the system CPU 51 may notify the remote management device via the external I/F 56 of the guidance for prompting the adjustment of the position of the transfer belt where the failure occurs.

In Act 6, if it is determined that there is at least one portion where the density information detection value is equal to or smaller than the density threshold value Vth in each color (No in Act 6), the printer CPU 61 determines whether or not there is a color in which there are not eight portions where the density information detection value (detection waveform 91) becomes equal to or smaller than the density threshold value Vth (Act 8). If it is determined that there is a color in which there are not eight portions where the density information detection value is equal to or smaller than the density threshold value Vth (Yes in Act 8), the printer CPU 61 determines that the image forming apparatus is in an abnormality Case 2 (Act 9).

Figure 11:
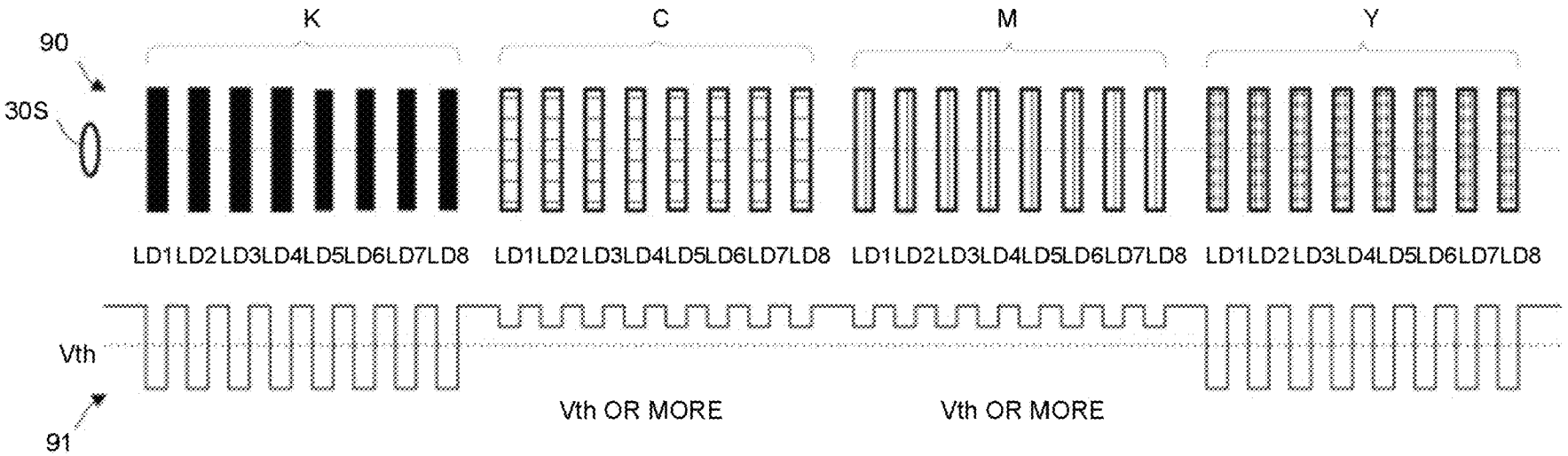
FIG. 11 is a diagram illustrating the dedicated pattern and the detection waveform of the toner adhesion sensor when an abnormality Case 2 occurs in the image forming apparatus according to the embodiment.

FIG. 11 is a diagram illustrating the dedicated pattern 90 and the detection waveform 91 of the toner adhesion sensor 35 when the abnormality Case 2 occurs in the image forming apparatus according to the embodiment. If there is a color in which there are not eight portions where the density information detection value is equal to or smaller than the density threshold value Vth, i.e., there is a color in which the printing density is thin (e.g., both C and M in the example in FIG. 11), it is highly likely that a positioning of the developing device corresponding to that color is poor. The poor positioning of the developing device refers to a state in which a distance between the developing device 32 and the transfer belt 27 is larger than a prescribed distance.

That there is a color in which there are not eight portions in which the density information detection value is smaller than or equal to the threshold value Vth as described above also includes a case in which no printing is performed in addition to a case in which the printing density of the color is thin. Since there is only one density threshold value Vth, it is impossible to distinguish the two cases. The case in which the printing is not performed is highly likely caused by failure in the primary transfer high voltage output. The failure in the primary transfer high voltage output refers to a state in which the transfer roller 33 does not apply the primary transfer voltage to the transfer belt 27.

Therefore, if there is a color in which there are not eight portions where the density information detection value is equal to or smaller than the density threshold value Vth, the printer CPU 61 predicts that the failure occurrence location is the position of the developing device of that color or the primary transfer high voltage output, and determines the poor positioning of the developing device of the color or the failure in the primary transfer high voltage output as the abnormality Case 2.

Then, the printer CPU 61 proceeds to the processing in Act 5 and terminates the processing of the failure occurrence location diagnosis operation after outputting the determination result, i.e., the determination as the abnormality Case 2 to the system CPU 51 that instructs the failure occurrence location diagnosis operation. The system CPU 51 receiving the determination of the abnormality Case 2 can notify the user or the service person of the determination result such as "there is possibility of poor positioning of the developing device of ? color, or failure in the primary transfer high voltage output of ? color" by displaying the determination result on the display section 4*a* of the operation panel 4. Here, "? color" is a color in which there are not eight portions where the density information detection value is equal to or smaller than the density threshold value Vth, and in the example in FIG. 11, "? color" refers to the "C and M". The system CPU 51 may notify the determination result to the remote monitoring device (external device) via the external I/F 56. Furthermore, the system CPU 51 may display a message for promoting maintenance by the service person such as inspection or replacement of the location where the failure occurs on the display section 4*a*. For example, the system CPU 51 may display, on the display section 4*a*, a guidance for promoting the adjustment of the position of the developing device 32 of the color in which the failure occurs or the inspection of the transfer roller 33 of that color, or may notify the remote management device via the external I/F 56 of the guidance for promoting the adjustment of the position of the developing device 32 or the inspection of the transfer roller 33 for the color in which the failure occurs.

Since there is only one density threshold value Vth, it is impossible to distinguish between a case in which the printing density of the toner image is thin and a case in which the toner image is not printed merely by comparison with the density threshold value Vth. However, the both may be distinguished by other methods. For example, if the toner image is not printed, as the surface of the transfer belt 27 is continuously detected, the density information detection value is kept substantially constant. Therefore, if the density information detection value is kept substantially constant, it can be determined that the toner image is not printed. According to this result, the abnormality Case 2 may be divided into Case 2-1 indicating the poor positioning of the developing device and Case 2-2 indicating failure in the primary transfer high voltage output.

If it is determined that there is not a color in which there are eight portions where the density information detection value is equal to or smaller than the density threshold value Vth in Act 8 (No in Act 8), the printer CPU 61 determines whether or not there is a color in which there are not four portions where the density information detection value is equal to or smaller than the density threshold value Vth in the density information detection value (detection waveform 91) (Act 10). If it is determined that there is a color in which there are not four portions where the density information detection value is equal to or smaller than the density threshold value Vth (Yes in Act 10), the printer CPU determines that the image forming apparatus is in abnormality Case 3 (Act 11).

Figure 12:
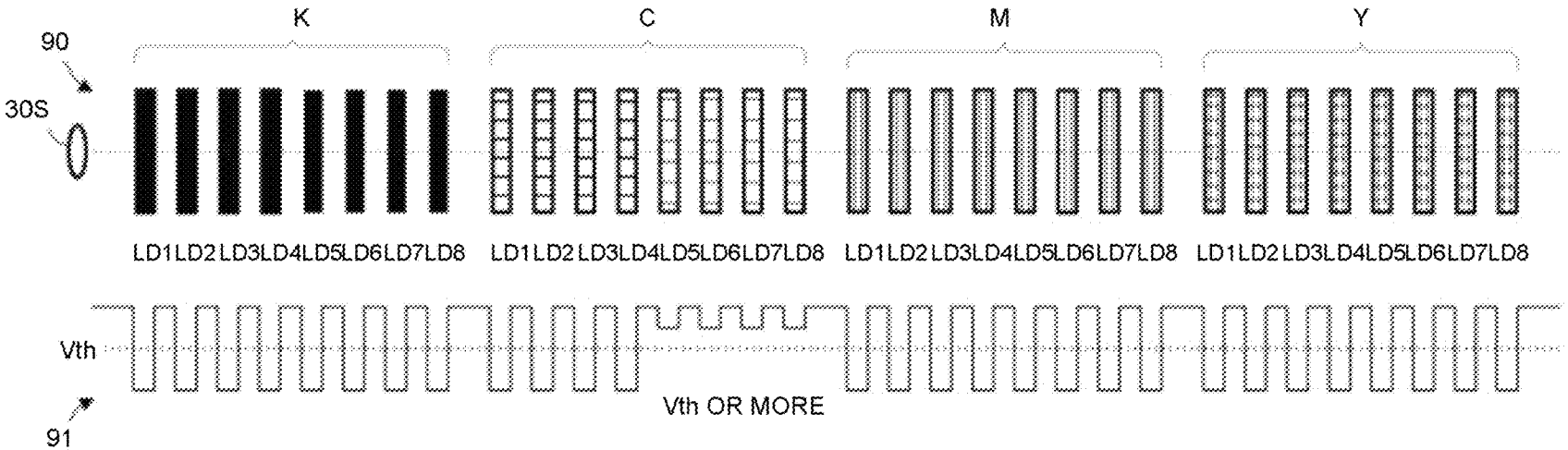
FIG. 12 is a diagram illustrating the dedicated pattern and the detection waveform of the toner adhesion sensor when an abnormality Case 3 occurs in the image forming apparatus according to the embodiment.

FIG. 12 is a diagram illustrating a dedicated pattern 90 and the detection waveform 91 of the toner adhesion sensor 35 when the abnormality Case 3 occurs in the image forming apparatus according to the embodiment. In this way, if there is a color in which there are not four portions where the density information detection value is equal to or smaller than the density threshold value Vth, i.e., if the printing density of the toner image is thin or no toner image is printed corresponding to four LDs (four beams) of any one of the colors (C in the example in FIG. 12), there is a high possibility that there is a failure in LDDs 82 of the four beams.

Therefore, if there is a color in which there are not four portions where the density information detection value is equal to or smaller than the density threshold Vth, the printer CPU 61 predicts that the failure occurrence location is the LDD 82 of that color, and determines the failure in the LDD of the color as the abnormality Case 3.

Then, the printer CPU 61 proceeds to the processing in Act 5 and terminates the processing of the failure occurrence location diagnosis operation after outputting the determination result, i.e., the determination as the abnormality Case 3 to the system CPU 51 that instructs the failure occurrence location diagnosis operation. The system CPU 51 receiving the determination of the abnormality Case can notify the user or the service person of the determination result such as "there is possibility that there is a failure in the LDD of ? color" by displaying the determination result on the display section 4*a* of the operation panel 4. Here, "? color" is a color in which there are not four portions where the density information detection value is equal to or smaller than the density threshold value Vth, and in the example in FIG. 12, "? color" refers to the "C". The system CPU 51 may notify the determination result to the remote monitoring device (external device) via the external I/F 56. Furthermore, the system CPU 51 may display a message for promoting maintenance by the service person such as inspection or replacement of the location where the failure occurs on the display section 4*a*. For example, the system CPU 51 may display, on the display section 4*a*, a guidance for promoting the inspection of the LDD 82 of the color in which the failure occurs, or may notify the remote management device via the external I/F 56 of the guidance for promoting the inspection of the LDD 82 of the color in which the failure occurs.

If it is determined that there is not a color in which there are not four portions where the density information detection value is equal to or smaller than the density threshold Vth (No in Act 10), the printer 61 determines whether or not there is a color in which there are at most three portions where the density information detection value is equal to or smaller than the density threshold Vth (Act 12). If it is determined that there is a color in which there are at most three portions where the density information detection value is equal to or smaller than the density threshold Vth (Yes in Act 12), the printer CPU 61 determines that the image forming apparatus is in an abnormality Case 4 (Act 13).

Figure 13:
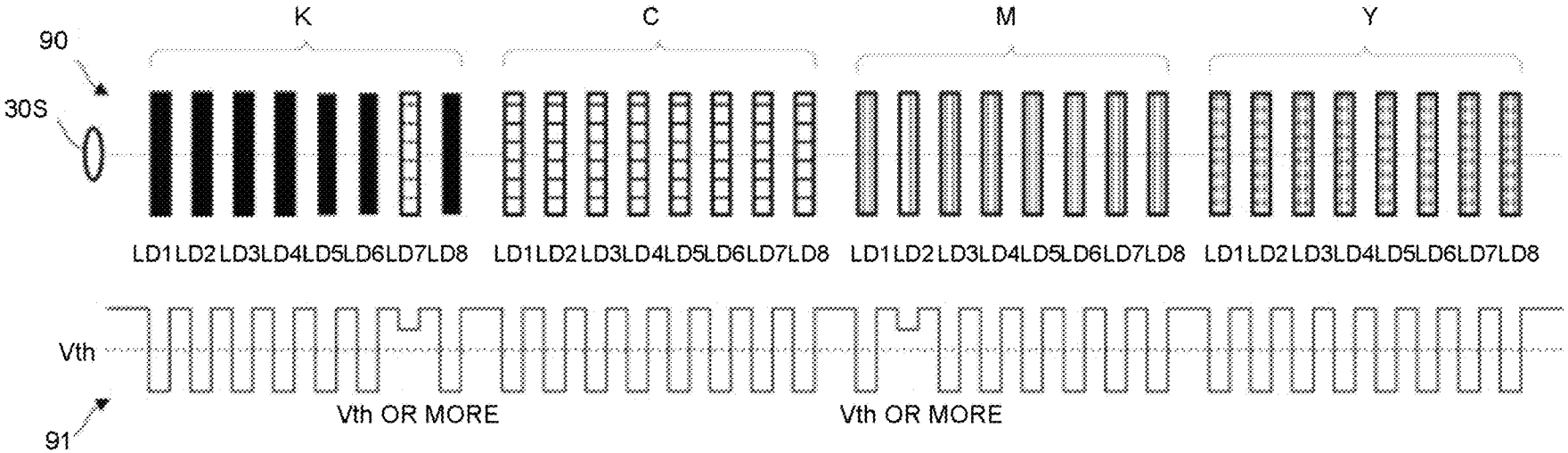
FIG. 13 is a diagram illustrating the dedicated pattern and the detection waveform of the toner adhesion sensor when an abnormality Case 4 occurs in the image forming apparatus according to the embodiment.

FIG. 13 is a diagram illustrating the dedicated pattern 90 and the detection waveform 91 of the toner adhesion sensor 35 when the abnormality Case 4 occurs in the image forming apparatus according to the embodiment. In this way, if there is a color in which there are at most three portions where the density information detection value is equal to or smaller than the density threshold Vth (only one for each of K and M in the example in FIG. 13), it is highly likely that failure occurs in the LD corresponding to the part where the density information detection value is equal to or smaller than the density threshold Vth.

Therefore, if there is a color in which there are at most three portions where the density information detection value is equal to or smaller than the density threshold Vth, the printer CPU 61 predicts that the failure occurrence location is the LD of that color, and determines the failure in the LD of the color as the abnormality Case 4.

Then, the printer CPU 61 proceeds to the processing in Act 5 and terminates the processing of the failure occurrence location diagnosis operation after outputting the determination result, i.e., the determination as the abnormality Case 4 to the system CPU 51 that instructs the failure occurrence location diagnosis operation. The system CPU 51 receiving the determination of the abnormality Case can notify the user or the service person of the determination result such as "there is possibility that there is a failure in the LD of ? color" by displaying the determination result on the display section 4*a* of the operation panel 4. Here, "? color" is a color in which there are at most three portions where the density information detection value is equal to or smaller than the density threshold value Vth, and in the example in FIG. 13, "? color" refers to the "K and M". The system CPU 51 may notify the determination result to the remote monitoring device (external device) via the external I/F 56. Furthermore, the system CPU 51 may display a message for promoting maintenance by the service person such as inspection or replacement of the location where the failure occurs on the display section 4*a*. For example, the system CPU 51 may display, on the display section 4*a*, a guidance for promoting the inspection of the LD of the color in which the failure occurs, or may notify the remote management device via the external I/F 56 of the guidance for promoting the inspection of the LD of the color in which the failure occurs.

If it is determined that there is not a color in which there are at most three portions where the density information detection value is equal to or smaller than the density threshold Vth (No in Act 12), the printer 61 determines whether or not the density information detection value (detection waveform 91) is always equal to or smaller than the density threshold Vth for all the colors (Act 14). If it is determined that the density information detection value is always equal to or smaller than the density threshold Vth (Yes in Act 14), the printer CPU 61 determines that the image forming apparatus is in an abnormality Case 5 (Act 15).

Figure 14:
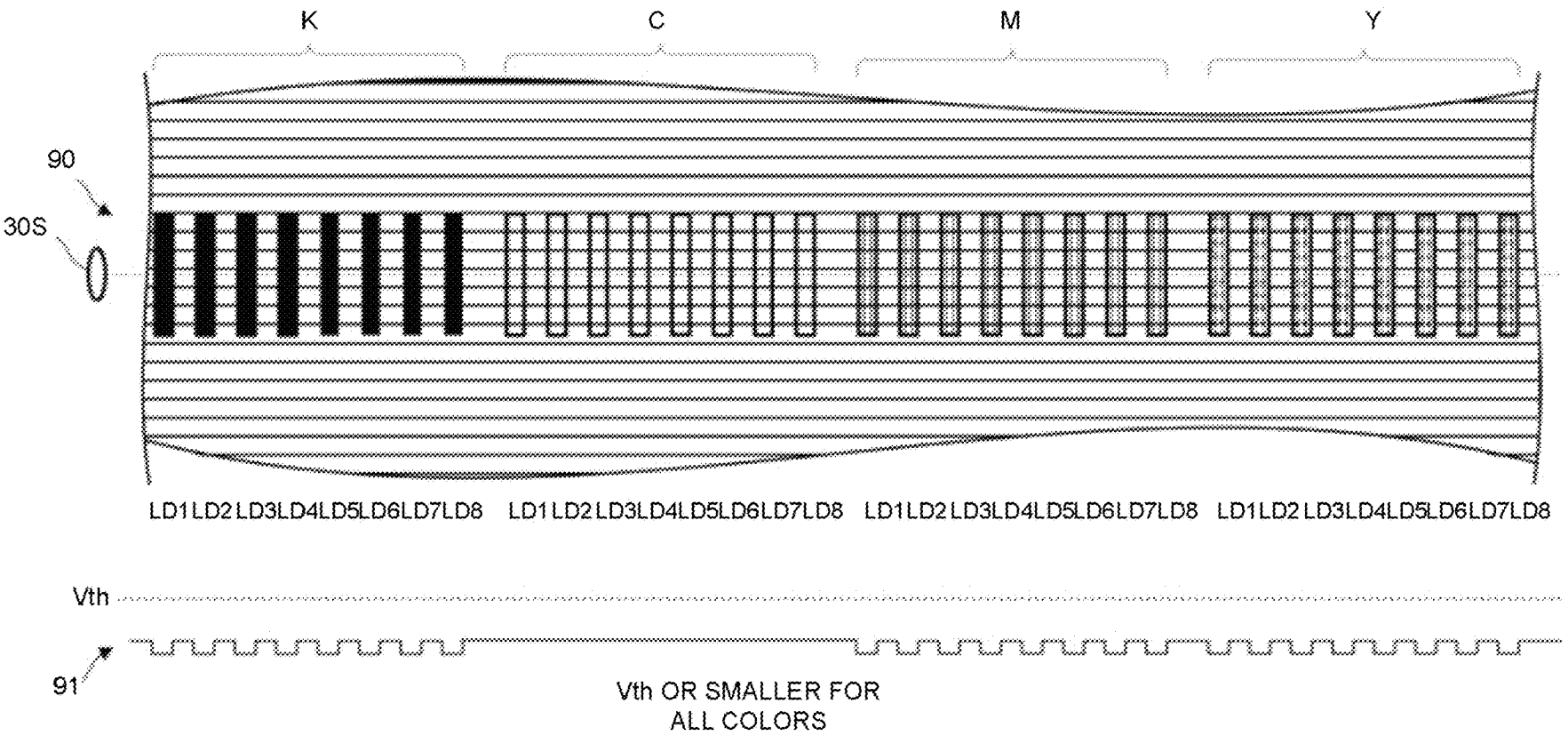
FIG. 14 is the dedicated pattern and the detection waveform of the toner adhesion sensor when an abnormality Case 5 occurs in the image forming apparatus according to the embodiment.

FIG. 14 is a diagram illustrating the dedicated pattern 90 and the detection waveform 91 of the toner adhesion sensor 35 when the abnormality Case 5 occurs in the image forming apparatus according to the embodiment. FIG. 14 shows a state in which a solid printing is performed with the toner of C. In other words, regardless of the dedicated pattern 90, the printing corresponding to C is printed on the surface of the transfer belt 27 in a width of the developing device 32*c*. In the detection waveform 91 in this case, in the toner image corresponding to a color other than C of the dedicated pattern 90, by superimposing the tone image corresponding to the C and the toner image corresponding to the color, a value smaller than the normal density information detection value is obtained.

In this way, if the density information detection value (detection waveform 91) is always equal to or smaller than the density threshold Vth, i.e., the density information detection values of both the portion where the toner image is printed and the portion where no toner image is printed on the surface of the transfer belt 27 are always equal to or smaller than the density threshold Vth, it is highly likely that the failure occurs in the charging high voltage output of the developing device 32 corresponding to any of YMCK. The failure in the charging high voltage output of the developing device 32 refers to a state in which no developing bias is applied to the developing roller of the developing device 32.

Therefore, if the density information detection value is always equal to or smaller than the density threshold Vth, the printer CPU 61 predicts that the failure occurrence location is the developing bias applied to the developing device 32 corresponding to any of YMCK, and determines the failure in charging high voltage output of the developing device 32 as the abnormality Case 5.

Then, the printer CPU 61 proceeds to the processing in Act 5 and terminates the processing of the failure occurrence location diagnosis operation after outputting the determination result, i.e., the determination as the abnormality Case 5 to the system CPU 51 that instructs the failure occurrence location diagnosis operation. The system CPU 51 receiving the determination of the abnormality Case can notify the user or the service person of the determination result such as "there is possibility that there is a failure in the charging high voltage output corresponding to any of YMCK" by displaying the determination result on the display section 4*a* of the operation panel 4. The system CPU 51 may notify the determination result to the remote monitoring device (external device) via the external I/F 56. Furthermore, the system CPU 51 may display a message for promoting maintenance by the service person such as inspection or replacement of the location where the failure occurs on the display section 4*a*. For example, the system CPU 51 may display, on the display section 4*a*, a guidance for promoting the inspection of the developing device 32 in which the failure occurs, or may notify the remote management device via the external I/F 56 of the guidance for promoting the inspection of the developing device 32 in which the failure occurs.

Since there is only one density threshold value Vth, it is impossible to determine in which color the charging high voltage output the failure occurs merely by comparison with the density threshold value Vth. However, if the normal printing operation is carried out, in which color the failure occurs can be identified at a glance.

The density information detection value is kept substantially constant in the portion where the toner image corresponding to the color in which the failure occurs is printed, as compared with the portion superimposed with the toner image of other colors. Therefore, if the density information detection value is kept substantially constant, it can be determined that the solid printing corresponding to that color is performed. According to the result, it is possible to notify in which color the failure in the charging high voltage output occurs.

If it is determined in Act 14 that the density information threshold value is not always equal to or smaller than the density threshold value Vth (No in Act 14), the printer CPU 61 determines that the failure occurrence location is undetectable (Act 16). Then, the printer CPU 61 proceeds to the processing in Act 5 and terminates the processing of the failure occurrence location diagnosis operation after outputting the determination result, i.e., the determination indicating that the failure occurrence location is undetectable to the system CPU 51 that instructs the failure occurrence location diagnosis operation. The system CPU 51 receiving the above determination result can notify the user or the service person of the determination result such as "the failure occurrence location cannot be diagnosed" by displaying the determination result on the display section 4*a* of the operation panel 4. The system CPU may notify the determination result to the remote monitoring device (external device) via the external I/F 56.

Actually, No is determined in Act 14. Therefore, if No is determined in Act 12, the flow may proceed to the processing in Act 15. In this case, Act 14 and Act 16 are omitted.

According to the above-described embodiment, the dedicated pattern 90 is formed on the surface of the transfer belt 27, and according to the density information detection value of the toner adhesion sensor 35, it is possible to determine the presence or absence of the failure in the image forming apparatus while determining the failure occurrence location. Specifically, from the information indicating whether the portion where the density information detection value is equal to or smaller than the density threshold Vth occurs in all colors or in only one color, whether the density information detection value is always equal to or smaller than the density threshold Vth, or the like, it is possible to analyze (diagnose) a main cause of the failure. Therefore, by using the known toner adhesion sensor 35 provided for the image quality maintaining control without having the failure detection function on hardware for each element unit, it is possible to specify the failure occurrence location without increasing the cost.

In the above-described embodiment, a case in which the program executed by the processor is recorded in advance in the memory in the apparatus is described. However, the program executed by the processor may be downloaded from the network to the apparatus, or may be installed from the recording medium to the apparatus. As the recording medium, any recording medium can be used as long as it can store a program such as a CD-ROM and can be read by the apparatus. The function obtained by installing or downloading the program in advance may be realized in cooperation with an OS (Operating System) or the like inside the apparatus.

In the above embodiment, a case in which the image forming apparatus is an MFP is described as an example, but the image forming apparatus may also be the image forming apparatus having a single printer function.

The image forming apparatus is not limited to a color printer capable of color printing, and it may be a monochrome printer that performs monochrome printing. In this case, Act 6 and Act 7 are omitted because the number of the image forming section 25 is only one, and if it is determined that there are not eight portions where the density information threshold value is equal to or smaller than the density threshold value Vth in Act 8 (Yes in Act 8), the abnormality Case 2 determined in Act 9 contains the abnormality Case 1 and the abnormality Case 2 in the color printer. In other words, the abnormality Case 2 refers to any one of the failure in the positioning of the transfer belt, the failure in the positioning of the developing device, and the failure in the primary transfer high voltage output.

The exposure section 26 of the image forming apparatus is not limited to the laser scanning type as shown in FIG. 2 and FIG. 3, and the exposure section 26 may be a fixed exposure section in which LEDs are aligned as the light emitting elements along the photoconductive drum 30. In this case, the LEDs may be divided into blocks in such a manner that a predetermined quantity of LEDs is driven by one driving circuit. If the LEDs are not divided into blocks, it is possible to omit Act 10 and Act 11.

The above embodiment shows an example in which the eight-beam laser unit 40 is driven by two LDDs 82. In other cases, the number in Act 3, Act 8, Act 10, and Act 12 is changed according to the number of LDs of the laser unit 40 and the number of the LDs corresponding to one LDD 82.

While certain embodiments have been described, these embodiments have been presented by way of example only, and are not intended to limit the scope of invention. Indeed, the novel apparatus and methods described herein may be embodied in a variety of other forms; furthermore, various omissions, substitutions and changes in the form of the apparatus and methods described herein may be made without departing from the spirit of the inventions. The accompanying claims and their equivalents are intended to cover such forms or modifications as would fall within the scope and spirit of the inventions.

What is claimed is:

1. A failure occurrence location diagnosis method by an image forming apparatus comprising an exposure section in which a plurality of light emitting elements is divided into a plurality of blocks, and the plurality of the light emitting elements belonging to the same block is driven by one driving circuit, comprising:

forming a dedicated pattern containing toner images corresponding to the plurality of the light emitting elements on a surface of a transfer belt onto which a toner image is transferred, wherein the toner image is exposed by light emitted from the exposure section, developed by a toner, and formed on a photoconductive drum;

acquiring density information of the toner image transferred onto the surface of the transfer belt; and diagnosing the plurality of light emitting elements and other possible failure occurrence locations in the image forming apparatus from density information of the toner image corresponding to each of the plurality of the light emitting elements in the dedicated pattern.

2. The method according to claim 1, further comprising:

forming the dedicated pattern in such a manner that the toner images are printed at intervals in a traveling direction of the transfer belt, and a density information detection value acquired by a toner adhesion sensor is equal to or greater than a density threshold value at a portion on a surface of the transfer belt where no toner image is printed, and is smaller than the density threshold value at a portion where the toner image is printed.

3. The method according to claim 2, further comprising:

if the density information acquired by the toner adhesion sensor is equal to or greater than the density threshold value for all portions where the toner image is printed, determining that a failure in primary transfer high voltage output relating to application of a primary transfer high voltage to the transfer belt, a failure in positioning of a developing device relating to a distance between the developing device and the transfer belt, or a failure in positioning of the transfer belt relating to a distance between the transfer belt and the photoconductive drum occurs.

4. The method according to claim 2, further comprising:

using toners of different colors from a plurality of image forming sections;

printing toner images at intervals in the travelling direction of transfer belt in each color in the dedicated pattern; and if the density information acquired by the toner adhesion sensor is equal to or greater than the density threshold value in all portions where the toner image is printed in all colors, determining that a failure in the positioning of transfer belt relating to a distance between the transfer belt and the photoconductive drum occurs.

5. The method according to claim 2, further comprising:

using toners of different colors from a plurality of image forming sections;

printing toner images at intervals in the travelling direction of transfer belt in each color in the dedicated pattern;

if the density information acquired by the toner adhesion sensor is equal to or greater than the density threshold value in all portions where the toner image is printed in all colors, determining that the failure in the primary transfer high voltage output relating to application of the primary transfer high voltage to the transfer belt, or the failure in the positioning of a developing device relating to a distance between the developing device and the transfer belt occurs.

6. The method according to claim 2, further comprising:

if the density information acquired is equal to or greater than the density threshold value in a portion where the toner image is printed by using the light from any one driving circuit among the portions where the toner image is printed, determining that a failure occurs in the driving circuit.

7. The method according to claim 2, further comprising:

if the density information acquired is equal to or greater than the density threshold value in a portion where the toner image is printed by using the light from any one of the light emitting elements among the portions where the toner image is printed, determining that a failure occurs in the light emitting element.

8. The method according to claim 2, further comprising:

if the density information acquired is smaller than the density threshold value in all the surface of the transfer belt regardless of whether the toner image is printed, determining that a failure occurs in a charging high voltage output of a developing roller of a developing device in an image forming section.

9. The method according to claim 1, further comprising:

outputting a determination result.

10. An image forming apparatus, comprising:

an exposure section in which a plurality of light emitting elements is divided into a plurality of blocks, and the plurality of the light emitting elements belonging to the same block is driven by one driving circuit;

an image forming section comprising a charging device, a photoconductive drum which is charged by the charging device and is exposed by light emitted from the exposure section to form an electrostatic latent image thereon, and a developing device which includes a developing roller for supplying a toner and forming a toner image on the photoconductive drum by developing the electrostatic latent image on the photoconductive drum;

a transfer belt onto which the toner image on the photoconductive drum of the image forming section is transferred;

a toner adhesion sensor configured to acquire density information of the toner images transferred onto a surface of the transfer belt; and a controller configured to control the exposure section and the image forming section to form a dedicated pattern containing toner images corresponding to the plurality of the light emitting elements on the surface of the transfer belt and to diagnose the plurality of light emitting elements and other possible failure occurrence locations in the image forming apparatus from the density information of the toner images corresponding to the plurality of the light emitting elements in the dedicated pattern, which is acquired by the toner adhesion sensor.

11. The image forming apparatus according to claim 10, wherein the controller controls the image forming section to form the dedicated pattern in such a manner that the toner images are printed at intervals in a traveling direction of the transfer belt, and a density information detection value acquired by the toner adhesion sensor is equal to or greater than a density threshold value at a portion on a surface of the transfer belt where no toner image is printed, and is smaller than the density threshold value at a portion where the toner image is printed.

12. The image forming apparatus according to claim 11, wherein if the density information acquired by the toner adhesion sensor is equal to or greater than the density threshold value for all portions where the toner image is printed, determining that a failure in primary transfer high voltage output relating to application of a primary transfer high voltage to the transfer belt, a failure in positioning of the developing device relating to a distance between the developing device and the transfer belt, or a failure in positioning of the transfer belt relating to a distance between the transfer belt and the photoconductive drum occurs.

13. The image forming apparatus according to claim 11, further comprising:

a plurality of the image forming sections, and a plurality of the image forming sections respectively uses toners of different colors, wherein in the dedicated pattern, toner images are printed at intervals in the travelling direction of transfer belt in each color, and if the density information acquired by the toner adhesion sensor is equal to or greater than the density threshold value in all portions where the toner image is printed in all colors, determining that a failure in the positioning of transfer belt relating to a distance between the transfer belt and the photoconductive drum occurs.

14. The image forming apparatus according to claim 11, further comprising:

a plurality of the image forming sections, and a plurality of the image forming sections respectively uses toners of different colors, wherein in the dedicated pattern, toner images are printed at intervals in the travelling direction of transfer belt in each color, and if the density information acquired by the toner adhesion sensor is equal to or greater than the density threshold value in all portions where the toner image is printed in all colors, determining that the failure in the primary transfer high voltage output relating to application of the primary transfer high voltage to the transfer belt, or the failure in the positioning of the developing device relating to a distance between the developing device and the transfer belt occurs.

15. The image forming apparatus according to claim 11, wherein if the density information acquired by the toner adhesion sensor is equal to or greater than the density threshold value in a portion where the toner image is printed by using the light from any one driving circuit among the portions where the toner image is printed, determining that a failure occurs in the driving circuit.

16. The image forming apparatus according to claim 11, wherein if the density information acquired by the toner adhesion sensor is equal to or greater than the density threshold value in a portion where the toner image is printed by using the light from any one of the light emitting elements among the portions where the toner image is printed, determining that a failure occurs in the light emitting element.

17. The image forming apparatus according to claim 11, wherein if the density information acquired by the toner adhesion sensor is smaller than the density threshold value in all the surface of the transfer belt regardless of whether the toner image is printed, determining that a failure occurs in a charging high voltage output of the developing roller of the developing device in the image forming section.

18. The image forming apparatus according to claim 10, further comprising:

an output section configured to output a determination result of the controller.

19. An image forming apparatus, comprising:

an exposure section in which a plurality of light emitting elements is divided into a plurality of blocks, and the plurality of the light emitting elements belonging to the same block is driven by one driving circuit;

a plurality of image forming sections each comprising a charging device, a photoconductive drum which is charged by the charging device and is exposed by light emitted from the exposure section to form an electrostatic latent image thereon, and a developing device which includes a developing roller for supplying a toner and forming a toner image on the photoconductive drum by developing the electrostatic latent image on the photoconductive drum;

a plurality of the image forming sections respectively uses toners of different colors;

a transfer belt onto which the toner image on the photoconductive drum of the image forming sections is transferred;

a toner adhesion sensor configured to acquire density information of the toner images transferred onto a surface of the transfer belt; and a controller configured to control the exposure section and the image forming sections to form a dedicated pattern containing toner images corresponding to the plurality of the light emitting elements on the surface of the transfer belt and to diagnose the plurality of light emitting elements and other possible failure occurrence locations in the image forming apparatus from the density information of the toner images corresponding to the plurality of the light emitting elements in the dedicated pattern, which is acquired by the toner adhesion sensor.

20. The image forming apparatus according to claim 19, wherein the controller controls the image forming sections to form the dedicated pattern in such a manner that the toner images are printed at intervals in a traveling direction of the transfer belt, and a density information detection value acquired by the toner adhesion sensor is equal to or greater than a density threshold value at a portion on a surface of the transfer belt where no toner image is printed, and is smaller than the density threshold value at a portion where the toner image is printed.

* * * * *